US007464676B2

(12) United States Patent
Wiggins et al.

(10) Patent No.: US 7,464,676 B2
(45) Date of Patent: Dec. 16, 2008

(54) AIR DYNAMIC STEADY STATE AND TRANSIENT DETECTION METHOD FOR CAM PHASER MOVEMENT

(75) Inventors: Layne K. Wiggins, Plymouth, MI (US); Gregory P. Matthews, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 60 days.

(21) Appl. No.: 11/434,378

(22) Filed: May 15, 2006

(65) Prior Publication Data

US 2007/0017486 A1 Jan. 25, 2007

Related U.S. Application Data

(60) Provisional application No. 60/702,091, filed on Jul. 22, 2005.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,690,071 A * 11/1997 Jankovic ..... 123/436
6,738,706 B2 * 5/2004 Cullen et al. ..... 701/103
2003/0192495 A1 * 10/2003 Hagner et al. ..... 123/90.17

FOREIGN PATENT DOCUMENTS

EP 0584856 A2 * 3/1994

* cited by examiner

*Primary Examiner*—Zelalem Eshete

(57) ABSTRACT

An air dynamic steady state detection system for movement of a cam phaser of an internal combustion engine includes a cam position sensing device and a control module. The cam position sensing device generates a position signal based on a position of the cam phaser of the engine. The control module receives the position signal and applies first and second filters to the position signal to select either a transient or steady state condition. The control module also calculates an estimated air value based on the selection of the transient or steady state condition.

19 Claims, 3 Drawing Sheets

AIR DYNAMIC STEADY STATE AND TRANSIENT DETECTION METHOD FOR CAM PHASER MOVEMENT

CROSS-REFERENCE TO RELATED APPLICATIONS

This application claims the benefit of U.S. Provisional Application No. 60/702,091, filed on Jul. 22, 2005. The disclosure of the above application is incorporated herein by reference.

FIELD OF THE INVENTION

The present invention relates to control systems for internal combustion engines, and more particularly to systems and methods for detecting steady state and transient conditions of a cam phaser that are used for estimating air.

BACKGROUND OF THE INVENTION

Various methods exist for estimating the air in an internal combustion engine. One conventional method uses measurements from a mass airflow sensor to estimate an air value. Another conventional method uses speed density calculations to estimate the value.

The first method is shown to be inaccurate during movement of cam phasers coupled to intake and exhaust camshafts of the engine. The second method provides more accurate estimation during transient operating conditions of the cam phasers. Conventional methods of estimating air lack the ability to detect a transient operating condition or a steady state operating condition of the cam phasers and lack the ability to apply the proper air estimation method during the transient operating condition.

SUMMARY OF THE INVENTION

An air dynamic steady state detection system for movement of a cam phaser of an internal combustion engine according to the present invention includes a cam position sensing device and a control module. The cam position sensing device generates a position signal based on a position of the cam phaser of the engine. The control module receives the position signal and applies first and second filters to the position signal to select either a transient or steady state condition. The control module also calculates an estimated air value based on the selection of the transient or steady state condition.

In other features, the air dynamic steady state detection system includes a second cam position sensing device. The second cam position sensing device generates a second position signal of a second cam phaser of the engine. The cam phaser is coupled to an intake cam shaft of the engine and the second cam phaser coupled to an exhaust camshaft of the engine. The control module applies third and fourth filters to the second position signal and selects either a steady state or transient condition based on a difference between the first and second filters and a difference between the third and fourth filters.

In still other features, the control module calculates an estimated air value based on a speed density calculation when the control module determines the transient condition. When the control module determines the steady state condition, the control module calculates an estimated air value based on a mass airflow sensor signal and an engine speed. The control module controls a fuel injector of the engine based on the estimated air value.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
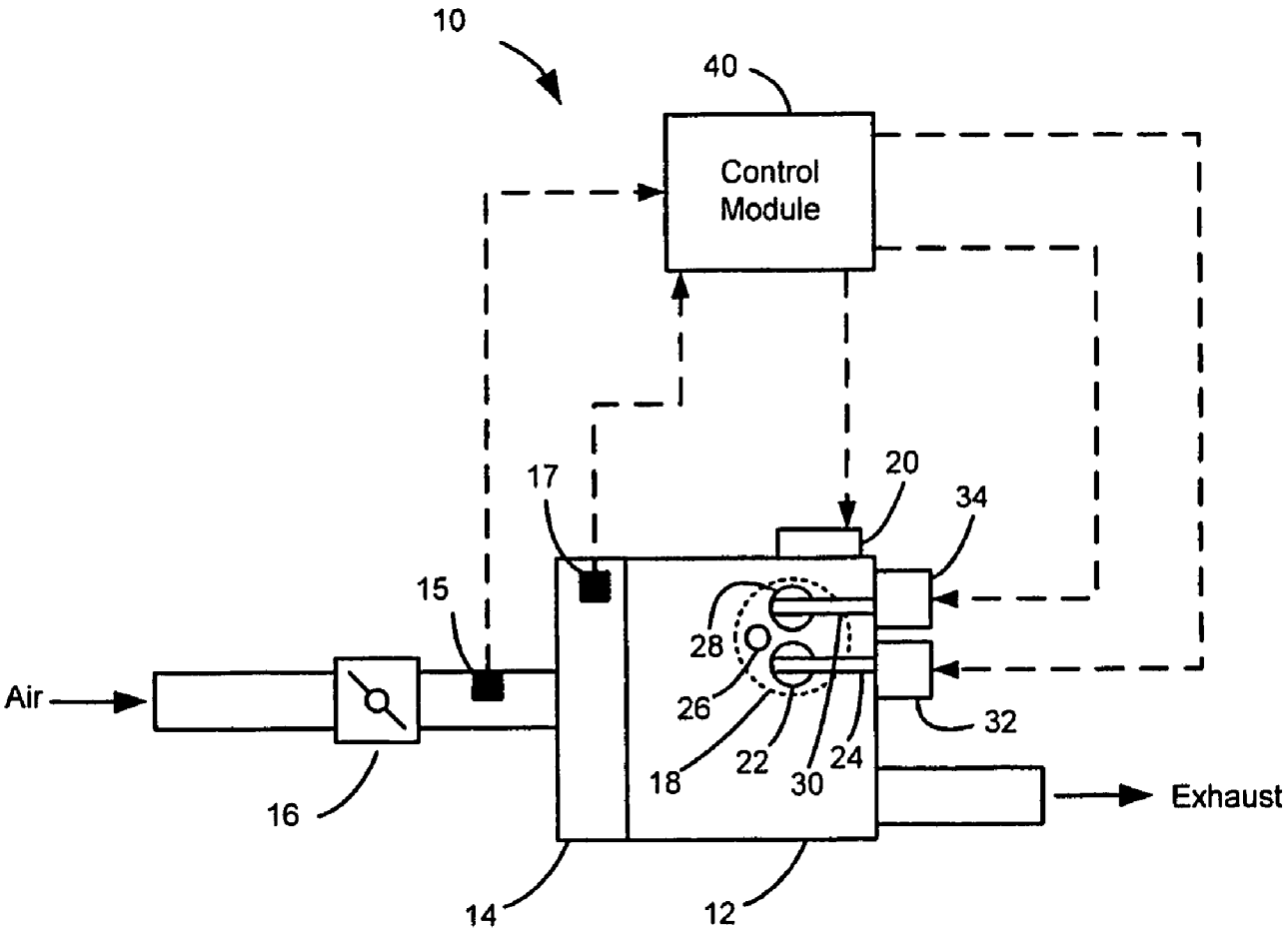
FIG. 1 is a functional block diagram illustrating a vehicle engine system including a control module that controls engine operation according to the air dynamic steady state detection system and method of the present invention.

The following description of the preferred embodiment(s) is merely exemplary in nature and is in no way intended to limit the invention, its application, or uses. For purposes of clarity, the same reference numbers will be used in the drawings to identify the same elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. A mass airflow sensor 15 senses the mass of air flowing into the engine. A manifold absolute pressure sensor 17 senses the air pressure in the intake manifold 14. Air within the intake manifold 14 is distributed into cylinders 18. Although a single cylinder 18 is illustrated, it is appreciated that the engine control system of the present invention can be implemented in engines having a plurality of cylinders including, but not limited to, 2, 3, 4, 5, 6, 8, 10 and 12 cylinders.

A fuel injector (not shown) injects fuel which is combined with the air as it is drawn into the cylinder 18 through an intake port. The fuel injector may be an injector associated with an electronic or mechanical fuel injection system 20, a jet or port of a carburetor or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque. Combustion exhaust within the cylinder 18 is forced out an exhaust port when an exhaust valve 28 is in an open position. The exhaust valve position is regulated by an exhaust camshaft 30. The exhaust is treated in an exhaust system. Although single intake and exhaust valves 22,28 are illustrated, it can be appreciated that the engine 12 can include multiple intake and exhaust valves 22,28 per cylinder 18.

The engine system 10 can include an intake cam phaser 32 and an exhaust cam phaser 34 that respectively regulate the rotational timing of the intake and exhaust camshafts 24,30. More specifically, the timing or phase angle of the respective intake and exhaust camshafts 24,30 can be retarded or advanced with respect to each other or with respect to a location of the piston within the cylinder 18 or crankshaft position. In this manner, the position of the intake and exhaust valves 22,28 can be regulated with respect to each other or with respect to a location of the piston within the cylinder 18. By regulating the position of the intake valve 22 and the exhaust valve 28, the quantity of air/fuel mixture ingested into the cylinder 18 and therefore the engine torque is regulated.

Figure 2:
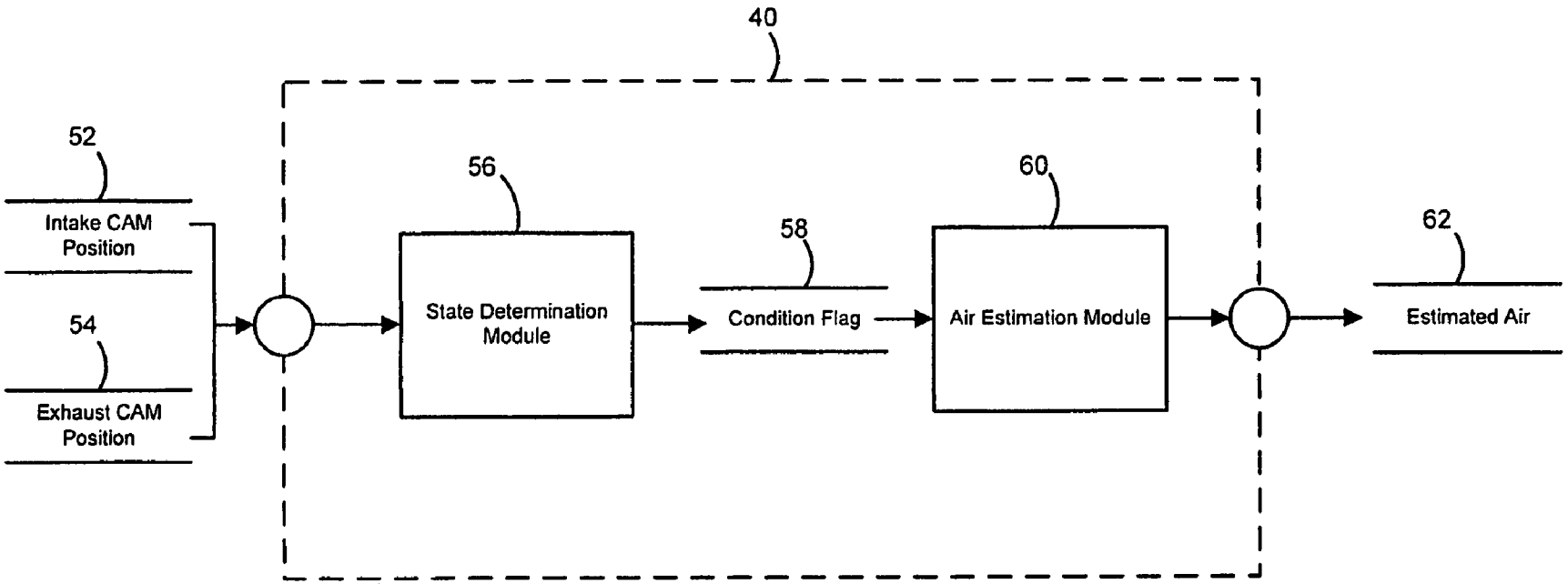
FIG. 2 is a data flow diagram illustrating a control module including an air dynamic steady state detection system according to the present invention.

A control module 40 detects transient and steady state operating conditions of the cam phasers 32, 34 and calculates an estimated air value 62 according to the present invention. Referring now to FIG. 2, the control module 40 is shown in more detail. The control module 40 receives an intake cam phaser position 52 and an exhaust phaser position 54. The positions can be either sensed from the cam phasers 32,34 (FIG. 1) or determined from other engine operating conditions. A state determination module 56 determines either a steady state operating condition or transient operating condition of each cam phaser. A cam phaser is operating in a transient condition when the cam phaser is moving. A cam phaser is operating in a steady state condition when the cam phaser is at rest. An air estimation module 60 calculates the estimated air value 62 based on a condition flag 58 received from the state determination module 56.

Figure 3:
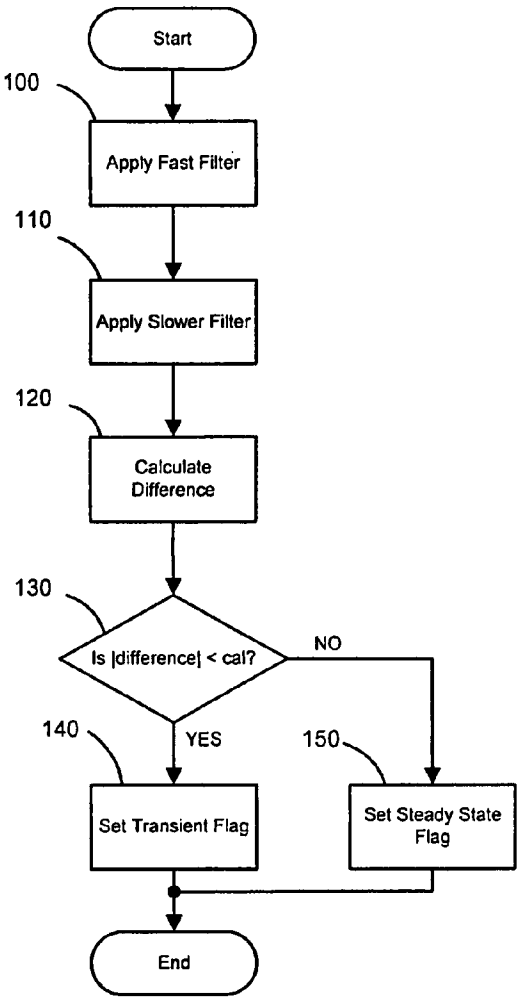
FIG. 3 is a flowchart illustrating the steps performed by the state determination module.

Referring to FIG. 3, the flowchart illustrates the steps performed by the state determination module according to the method of the present invention. In steps 100 and 110, a pair of lowpass filters are applied to the intake phaser position and/or the exhaust phaser position. In step 100 a fast lowpass filter is applied. In step 110, a slower lowpass filter is applied. When the cam phasers are not moving, the output of both filters will be the same. However, when either cam phaser moves the filters will produce different outputs. In step 120, a difference between the filter outputs is calculated for the exhaust cam phaser position and/or the intake cam phaser position.

In step 130, if the absolute value of the intake position difference is greater than or equal to a first selectable threshold or the absolute value of the exhaust position difference is greater than or equal to a second selectable threshold, transient operating conditions are determined and a transient flag is set to TRUE. In step 130, if the absolute value of the intake position difference is less than the first selectable threshold or the absolute value of the exhaust position difference is less than the second selectable threshold, a steady state operating condition is determined and a steady state flag is set to TRUE. In an alternative embodiment, a variable size offset (truncation) can be applied to the differences to allow for the fact that the cam phasers can move some distance from the park position without providing a significant effect.

Figure 4:
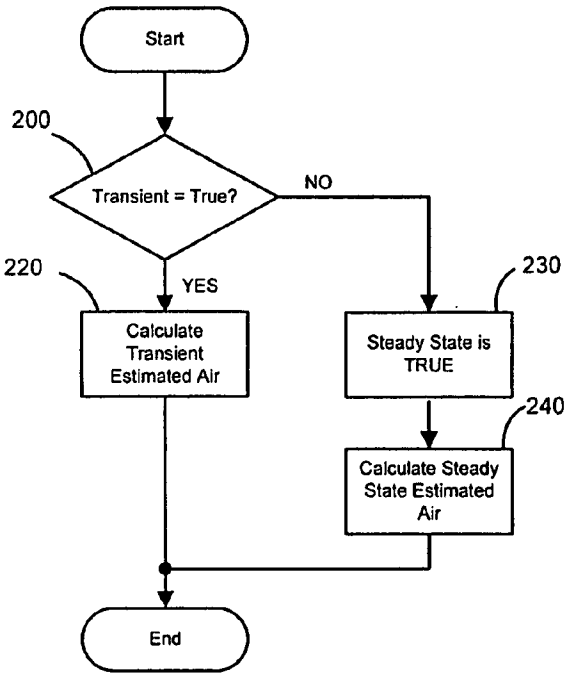
FIG. 4 is a flowchart illustrating the steps performed by the air estimation module.

Referring now to FIG. 4, the steps performed by the air estimation module 60 is shown in more detail. While the transient flag is set to TRUE, the estimator uses the speed density calculation method for the estimated air value. A transient estimated air value is calculated in step 220, based on a pressure of the intake manifold, an engine speed, the intake cam phaser position, the exhaust cam phaser position, and an estimated air temperature per cylinder. Otherwise, the steady state condition flag is TRUE in step 230 and a steady state estimated air value is calculated based on a signal from the mass airflow sensor and an engine speed in step 240.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An air dynamic steady state detection system for movement of a cam phaser of an internal combustion engine, comprising:

a cam position sensing device that generates a position signal based on a position of said cam phaser of said engine; and a control module that receives said position signal and that applies first and second filters to said position signal to select one of a transient condition and a steady state condition, and wherein said control module calculates an estimated air value based on said selection of said transient condition and said steady state condition.

2. The system of claim 1 wherein said cam phaser is coupled to an intake camshaft of said engine.

3. The system of claim 1 wherein said cam phaser is coupled to an exhaust camshaft of said engine.

4. The system of claim 1 further comprising a second cam position sensing device that generates a second position signal of a second cam phaser of said engine, wherein said cam phaser is coupled to an intake camshaft of said engine and wherein said second cam phaser is coupled to an exhaust camshaft of said engine.

5. The system of claim 4 wherein said control module applies third and fourth filters to said second position signal and selects one of said steady state condition and said transient condition based on a difference between said first and second filters and a difference between said third and fourth filters.

6. The system of claim 1 wherein said control module calculates said estimated air value based on a speed density calculation when said control module determines said transient condition.

7. The system of claim 1 wherein said control module calculates said estimated air value based on a mass airflow sensor signal and an engine speed when said control module determines said steady state condition.

8. The system of claim 1 wherein said control module controls a fuel injector of said engine according to said estimated air value.

9. An air dynamic steady state detection method for cam phaser movement, comprising:

receiving a cam phaser position signal;

applying a first filter to said cam phaser position signal;

applying a second filter to said cam phaser position signal;

calculating a difference between an output of said first filter and an output of said second filter;

selecting a steady state condition when an absolute value of said difference is less than a predetermined value;

selecting a transient condition when said absolute value of said difference is greater than or equal to said predetermined value; and selecting a method for calculating an estimated air value based on said steady state condition and said transient condition.

10. The method of claim 9 further comprising controlling fuel delivery based on said estimated air value.

11. The method of claim 9 further comprising calculating said estimated air value based on a mass airflow sensor input and engine speed when said steady state condition is determined.

12. The method of claim 9 wherein said step of calculating said estimated air value includes calculating said estimated air value from an absolute pressure of an intake manifold, an engine speed, an intake cam phaser position, an exhaust cam phaser position, and an estimated air temperature per cylinder.

13. The method of claim 9 wherein said first filter has a faster time constant than said second filter.

14. An air dynamic steady state detection system, comprising:

a first cam position sensing device that generates an intake position signal based on a position of a first cam phaser associated with an intake camshaft;

a second cam position sensing device that generates an exhaust position signal based on a position of a second cam phaser associated with an exhaust camshaft;

a state determination module that selects one of a transient condition and a steady state condition of said intake camshaft and said exhaust camshaft; and an air estimation module that calculates an estimated air value based on said transient condition and said steady state condition of said intake camshaft and said exhaust camshaft.

15. The system of claim 14 wherein said state determination module applies first and second filters to said intake position signal and said exhaust position signal, determines a difference between said first and second filters, and wherein said transient condition and said steady state condition are determined based on said difference.

16. The system of claim 14 wherein said state determination module determines said transient condition when an absolute value of at least one of said difference of said intake camshaft and said difference of said exhaust camshaft is greater than or equal to a predetermined value.

17. The system of claim 15 wherein said state determination module determines a steady state condition when an absolute value of at least one of said difference of said exhaust camshaft and said difference of said intake camshaft is less than said predetermined value.

18. The system of claim 14 wherein said air estimation module calculates said estimated air value based on an absolute pressure of an intake manifold, an engine speed, an intake cam phaser position, an exhaust cam phaser position, and an estimated air temperature per cylinder when said transient condition is determined.

19. The system of claim 14 wherein said air estimation module calculates said estimated air value based on a mass airflow sensor value and an engine speed when said steady state condition is determined.

* * * * *